US008789859B2

(12) United States Patent
Curtis et al.

(10) Patent No.: US 8,789,859 B2
(45) Date of Patent: Jul. 29, 2014

(54) ELECTRONIC LOCK FOR A ROLLUP DOOR

(75) Inventors: David Bryan Curtis, Villa Rica, GA (US); Adam David Nyman, Villa Rica, GA (US)

(73) Assignee: Janus International Group, LLC, Temple, GA (US)

( * ) Notice: Subject to any disclaimer, the term of this patent is extended or adjusted under 35 U.S.C. 154(b) by 0 days.

(21) Appl. No.: 13/086,895

(22) Filed: Apr. 14, 2011

(65) Prior Publication Data

US 2012/0261081 A1 Oct. 18, 2012

(51) Int. Cl.
*E05C 3/06* (2006.01)
*E05C 17/56* (2006.01)

(52) U.S. Cl.
USPC ..... 292/201; 292/251.5; 292/DIG. 25; 292/DIG. 36

(58) Field of Classification Search
USPC ..... 292/201, 216, 251.5, DIG. 25, DIG. 36
See application file for complete search history.

(56) References Cited

U.S. PATENT DOCUMENTS 654,383 A * 7/1900 Carleton ..... 292/201
1,199,199 A * 9/1916 Mason ..... 292/201
3,111,339 A 11/1963 Nadeau
3,325,203 A * 6/1967 Moler ..... 292/201
3,620,560 A * 11/1971 Peters ..... 292/201
3,667,791 A 6/1972 Kazaoka et al.
3,733,861 A * 5/1973 Lester ..... 70/153
3,917,330 A * 11/1975 Quantz ..... 292/216
3,942,828 A * 3/1976 Bourrie et al. ..... 292/201
3,955,840 A * 5/1976 Rawls et al. ..... 292/229
4,030,322 A * 6/1977 Pettit ..... 70/159
4,132,177 A 1/1979 Funk
4,268,076 A * 5/1981 Itoi ..... 292/216
4,468,545 A * 8/1984 Slavin ..... 200/61.64
4,869,536 A * 9/1989 Kleefeldt ..... 292/210
4,893,852 A * 1/1990 Harris et al. ..... 292/251.5
4,978,153 A * 12/1990 Hirsch et al. ..... 292/201
5,489,130 A 2/1996 Clark
5,575,515 A * 11/1996 Iwamoto et al. ..... 292/341.17
5,632,317 A 5/1997 Krupke et al.
6,035,676 A * 3/2000 Hudspeth ..... 70/278.1
6,053,546 A * 4/2000 Frolov ..... 292/251.5
6,073,980 A * 6/2000 Arabia et al. ..... 292/340
6,097,306 A 8/2000 Leon et al.

(Continued)

OTHER PUBLICATIONS

Search Report and Written Opinion for International Application No. PCT/US2012/033285; Jul. 13, 2012.

*Primary Examiner* — Carlos Lugo
(74) *Attorney, Agent, or Firm* — Jason A. Bernstein; Barnes & Thornburg LLP

(57) ABSTRACT

An electronic locking apparatus for a rollup door, including a striker plate and a locking apparatus having a housing; a U-shaped trigger latch pivotably mounted to the housing having a notch and a spring; and a release catch pivotably mounted to the housing, a tab which can engage the notch and a spring. A solenoid is associated with a piston, which is connected to the release catch and can cause the release catch to pivot positions. Also included is a control assembly including a processor, user interface and memory storage device. A user can enter access information into the user interface, which causes the processor to actuate the solenoid, which moves the piston and causes the release catch to pivot. The release catch tab engages or disengages from the trigger latch tab to pivot and release or retain the striker plate.

3 Claims, 18 Drawing Sheets

(56) References Cited

U.S. PATENT DOCUMENTS

| | | | | |
|---|---|---|---|---|
| 6,112,564 | A * | 9/2000 | Rathmann et al. | 70/279.1 |
| 6,435,573 | B1 * | 8/2002 | Szablewski | 292/201 |
| 6,454,324 | B1 * | 9/2002 | Lewis et al. | 292/341.16 |
| 6,523,376 | B2 * | 2/2003 | Baukholt et al. | 70/256 |
| 6,659,515 | B2 * | 12/2003 | Raymond et al. | 292/201 |
| 7,603,882 | B2 * | 10/2009 | Carbajal et al. | 70/267 |
| 8,047,582 | B1 * | 11/2011 | Rodgers et al. | 292/201 |
| 2003/0127867 | A1 | 7/2003 | Hale et al. | |
| 2005/0235711 | A1 | 10/2005 | Martin et al. | |

* cited by examiner

ELECTRONIC LOCK FOR A ROLLUP DOOR

FIELD

The present disclosure relates to locking apparatus and, more particularly, to an electronic locking apparatus for rollup or overhead doors.

BACKGROUND

FIG. 1 shows a conventional rollup door 10 (also known as an overhead door) system which typically includes first and second opposing vertical guide tracks 12, 14 which are mounted in the doorway opening. A rollup door 16 typically has a curtain 18 made of a number of slats which moves within the guide tracks. A bottom base member 20 comprising an elongated bar is at the bottom of the rollup door. The bar may comprise an L-shape in cross-section having a vertical section 22 and a horizontal section 24. The bar typically has a handle 26 for manual raising and lowering. Mounted over the door 16 is a tension wheel 28 and associated drive mechanism (not shown) for manual and/or motor driven moving the door. A conventional door lock mechanism typically has a locking bar 30 slidingly mounted to the rollup door 16 and either an aperture 32 in one or both of the guide tracks 12 or 14 or a striker plate having an aperture and mounted to one of the guide tracks. When the door 16 is positioned for locking, the locking bar 30 slides into the aperture 32 and the door 16 is maintained in relative position until the mechanism is unlocked. A lock, such as a combination or key lock, is manually attached to the locking bar (either directly or indirectly) to prevent unlocking by anyone other than the user. A sectional door, most commonly found in residential garages, comprises a set of sections which have a number of guide rollers mounted on axles which roll within the guide tracks.

One problem with such manual locking systems is that the locking mechanism relies on the tenant providing an external lock which is necessarily accessible by anyone from outside of the storage unit, and which can be cut by a thief with a bolt cutter. Another problem with a manual locking system is that if the tenant loses the key a bolt cutter is needed to be able to unlock the door. Also, in the event that a tenant fails to pay rent, the facility manager typically must add an additional lock to the locking mechanism to prevent the tenant from accessing the storage unit until the rent is paid. However, the tenant can cut the facility's lock with a bolt cutter.

It would be desirable to have a rollup door security and locking system which would eliminate the need for externally accessible locks. It would be desirable for such a system to permit remote control of access by a facility manager. It would be desirable for such a system to provide access to users by a user interface which would be more reliable than a combination or key lock.

SUMMARY

The present disclosure provides an electronic locking apparatus for remote control of locking and unlocking of a door, particularly a rollup door.

In one exemplary embodiment, the present disclosure provides an electronic locking apparatus for a rollup door, including a striker plate and a latch assembly including a housing, a U-shaped trigger latch pivotably mounted to the housing and having a notch. The latch assembly also includes a release catch pivotably mounted to the housing, the release catch having a tab which can engage the notch. The trigger latch and the release catch may also each include a spring which biases each in a first position. The latch assembly also includes a solenoid associated with a piston which is connected to the release catch and can cause the release catch to pivot positions. Also included is a control assembly including a programmable logic controller, user interface and memory storage device. A user can enter access information into the user interface, which causes the PLC to actuate the solenoid, which moves the piston and causes the release catch to pivot. The release catch tab engages or disengages from the trigger latch tab to pivot and release or retain the striker plate.

Other features will become apparent upon reading the following detailed description of certain exemplary embodiments, when taken in conjunction with the appended claims.

BRIEF DESCRIPTION OF THE DRAWINGS

The drawings disclose exemplary embodiments in which like reference characters designate the same or similar parts throughout the figures of which.

DETAILED DESCRIPTION

Figure 1:
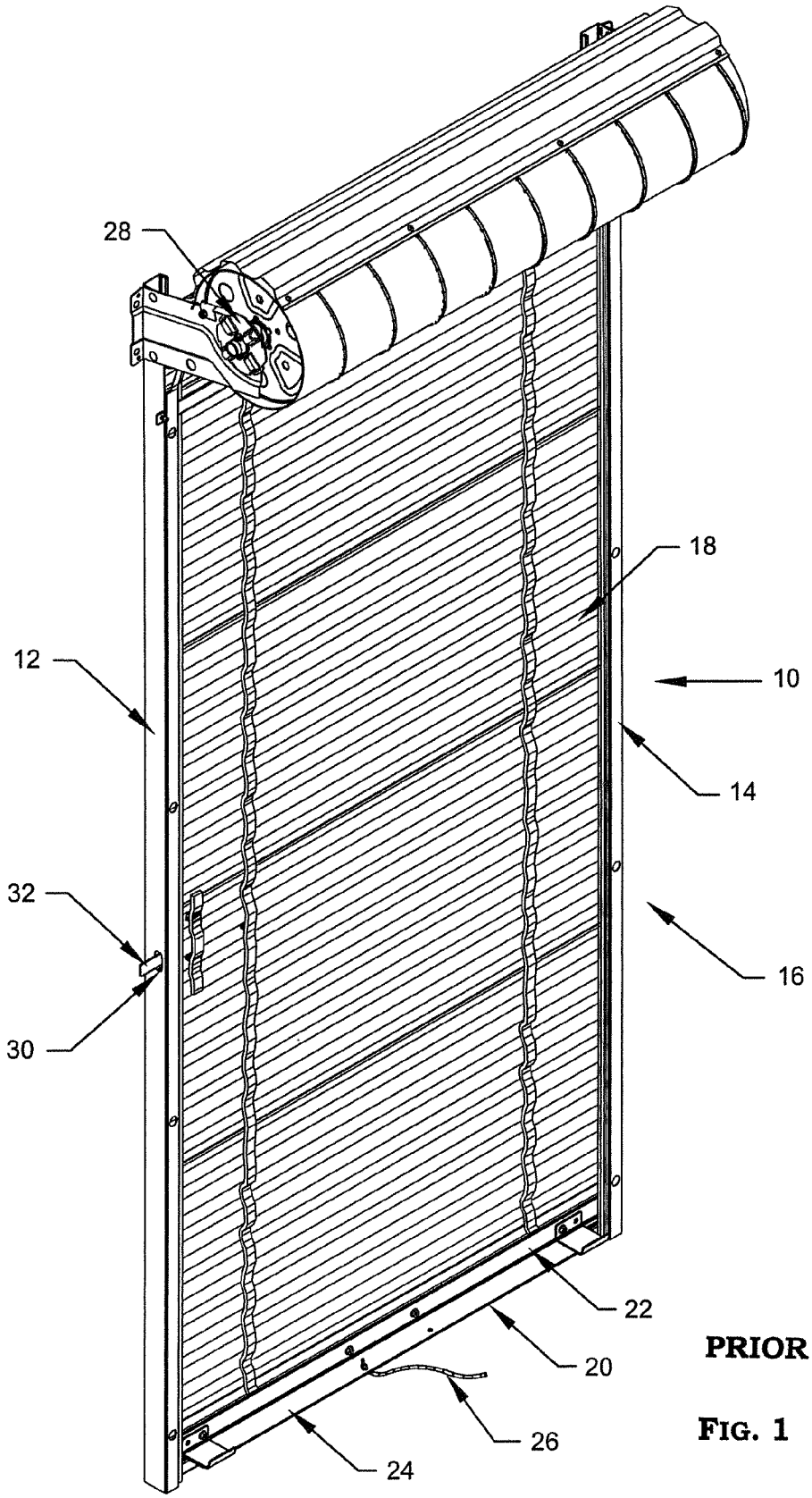
PRIOR ART FIG. 1
FIG. 1 (labeled "Prior Art") is a schematic view of a conventional rollup door.

FIGS. 2-5 show various views of a first exemplary embodiment of a locking apparatus 50 for use with a rollup 16 or sectional door system. The locking apparatus 50 includes a striker member 52, a latch assembly 54 and an electronic control assembly 56. It is to be understood that the locking apparatus of the present disclosure can be used with doors other than rollup doors, such as section doors, sliding doors, and the like and can also be used or adapted for use in other environments which can benefit from a remote controlled locking and unlocking access system. A rollup door will be discussed herein as a nonlimiting example.

Figure 2:
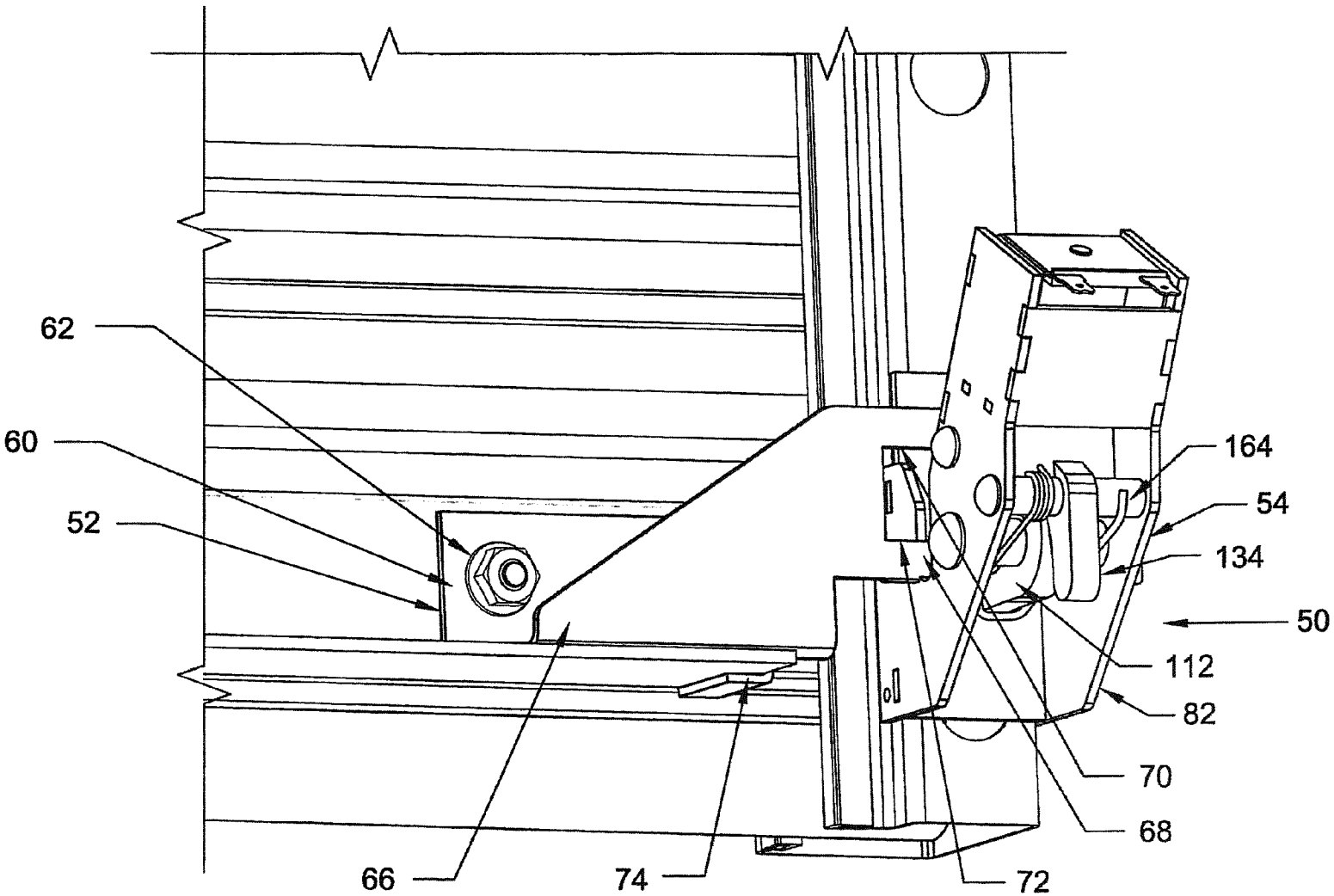
FIG. 2 is a perspective view of a first exemplary embodiment of a lock apparatus shown mounted to a rollup door system and with the striker plate engaged with the latch assembly.
Figure 6:
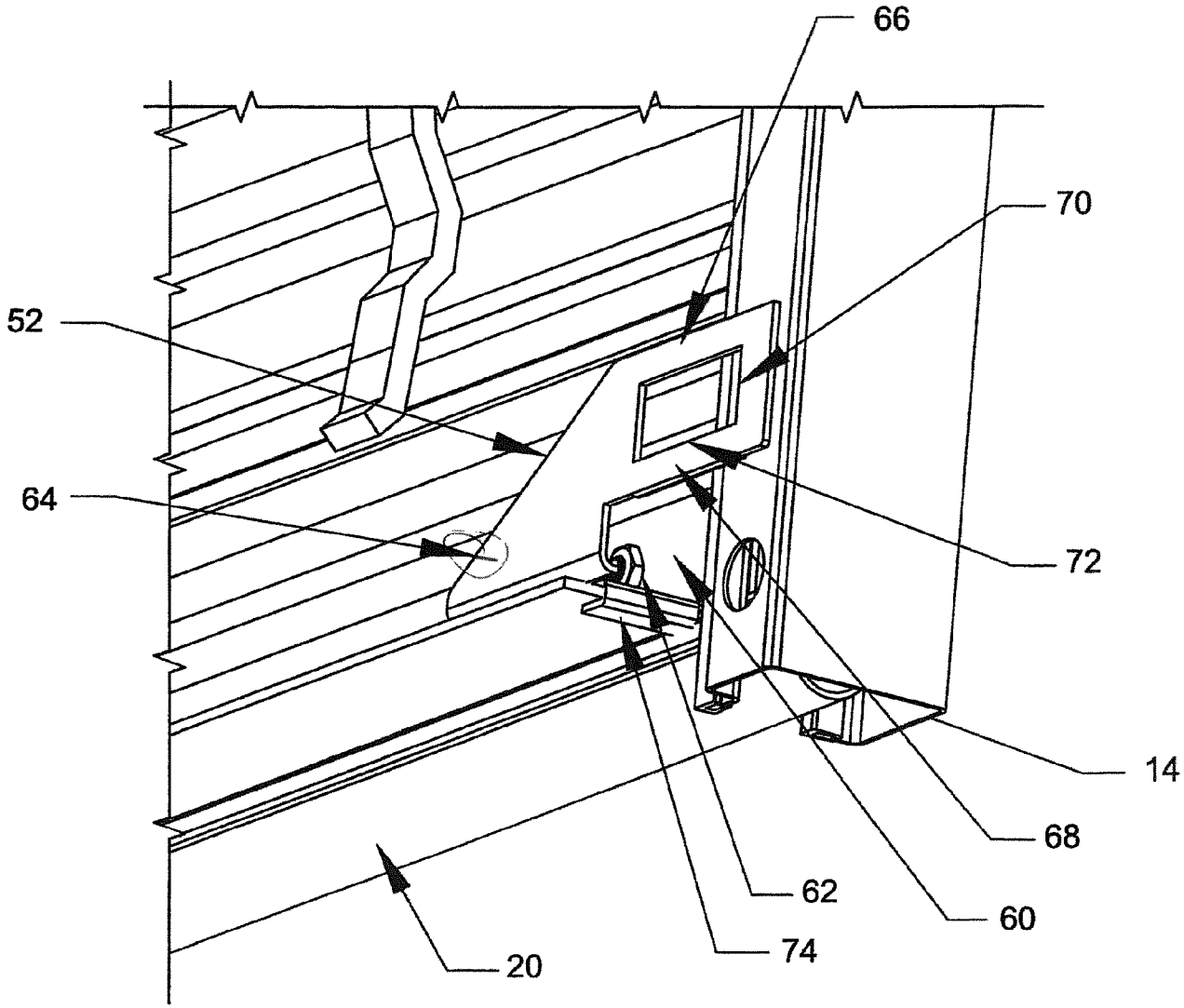
FIG. 6 is a perspective view of the first exemplary embodiment showing a striker member mounted to a rollup door.

The striker member 52, shown in FIGS. 2 and 6, includes a mounting portion 60 for attachment to the door 16. The mounting portion 60 may have a hole 62 formed therein to permit mounting to the vertical section 22 of the door base member 20. Alternatively, the striker member 52 can be welded, adhered, or otherwise fixedly fastened to the door base member 20 or the area proximate thereto. The striker member 52 may further include a generally perpendicular second portion 64 which is generally parallel and proximate to the horizontal section of the door base member 20. The striker member 52 may further include a vertical third section 66 having a striker plate 68 extending therefrom, the striker plate having an opening 70 defined therein. The bottom edge 72 of the striker plate opening 70 optionally may be formed so as to have an extra thickness of material. In one exemplary embodiment the second portion 63 optionally may have a generally U-shaped lip 74 which engages an end of the door base member horizontal section 24 to help maintain the striker member 52 in position.

Figure 4:
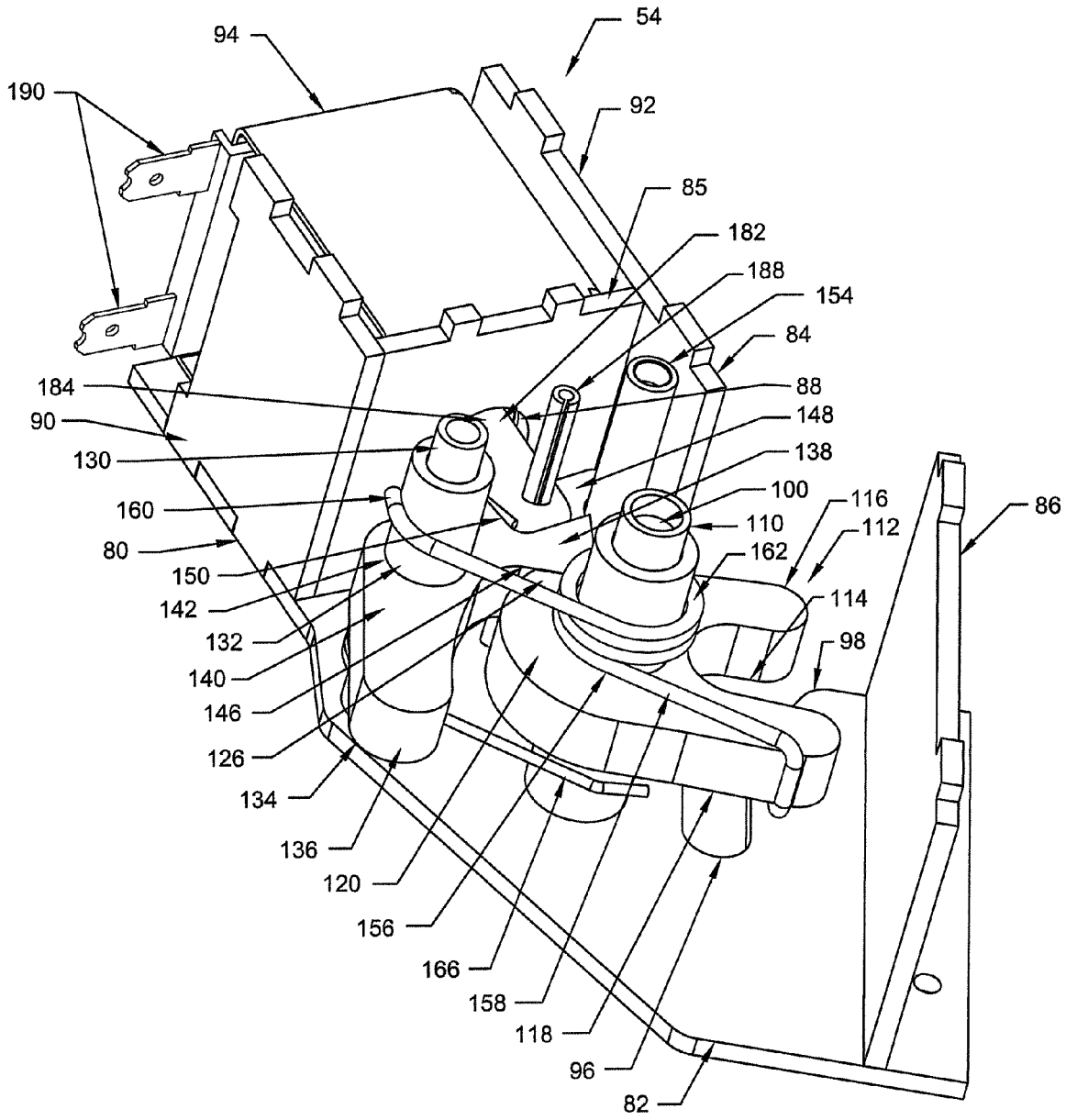
FIG. 4 is a perspective view in partial cutaway of the first exemplary embodiment of FIG. 2.
Figure 5:
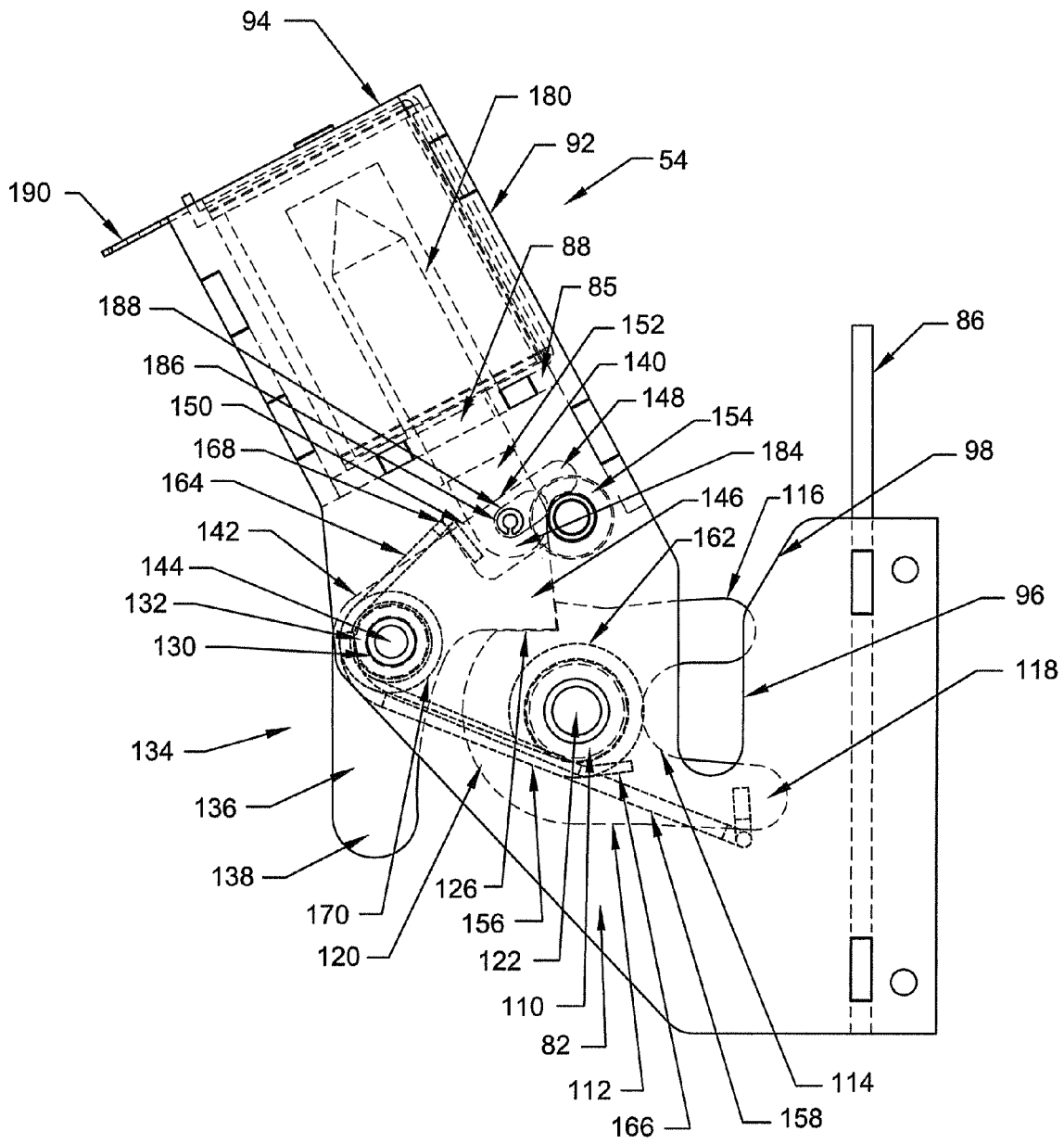
FIG. 5 is a side schematic view of the first exemplary embodiment of FIG. 2.

One exemplary embodiment of a latch assembly 54, shown in detail in FIGS. 4-5, may include a housing 80 having a first side plate 82, a second side plate 84, a bottom plate 85, a base/mounting plate 86, front and rear plates 90, 92, and a top plate 94. The first and second side plates 80, 82 each have a slot 96 which can receive the striker plate 68 when in the engaged position. The slots 80, 82 may have a beveled opening 98 to make facilitation insertion of the striker plate 68.

A first pin 100 is mounted between the two side plates 80, 82. Optionally, a first sleeve 110 may be fitted around at least a portion of the first pin 100. The first pin 100 and first sleeve 110 pass through a trigger latch 112. The trigger latch 112 is generally U-shaped, with a U-shaped opening 114 and has a first leg 116 and a second leg 118 extending from a middle portion 120, the middle portion 120 having a hole 122 to receive the first pin 100 and, if present, the first sleeve 100. The middle portion 120 has a notch 126 along one edge. The first leg 116 may be shorter than the second leg 118.

A second pin 130 is mounted between the two side plates 80, 82. Optionally, a second sleeve 132 may be fitted around at least a portion of the second pin 130. The second pin 130 and, if present, the second sleeve 132 pass through a release catch 134. In one exemplary embodiment (shown in FIG. 7, having a manual release feature) the release catch 134 comprises a first end portion 136, a second end portion 138, a middle portion 140, a hole 142 in the middle portion 140 to receive the second pin 130 and second sleeve 132, a tab 144 extending from one side of the second end portion 138 and a stop finger 146 extending from the end of the second end portion 138. The first end portion 136 may optionally have a manual release finger 148. The second end portion 138 further includes a portion having a narrower width portion which has a hole 150 passing transversely therethrough, thus forming a clevis tang 152.

Optionally, a stop pin 154 is mounted between the housing side plates 82, 84 and is contacted by the release catch stop finger 146. The stop pin 154 and stop finger 146 can provide additional strength.

A first spring 156, as shown in FIG. 4, has a first end 158, a second end 160 and a wound portion 162. The wound portion 162 is associated with the first pin 100 (and, if included, the first sleeve 110). The first end 158 is in an abutting relationship with the second leg 118 of the trigger latch 112. The second end 160 of the first spring 156 is in an abutting relationship with the second pin 130 (and, if included, the first sleeve 132). The first spring 156 is biased so as to urge the trigger latch 112 into a rotational position so that the trigger latch opening 114 is generally angled upward to permit engagement by the striker plate 68.

A second spring 164 has a first end 166, a second end 168 and a wound portion 170. The wound portion 170 is associated with the second pin 130 (and, if included, the second sleeve 132). The first end 166 is in an abutting relationship with the first pin 100 (and, if included, the first sleeve 110). The second end 168 wraps at least partially around, or is in an abutting relationship with the release catch second portion 138.

Figure 7:
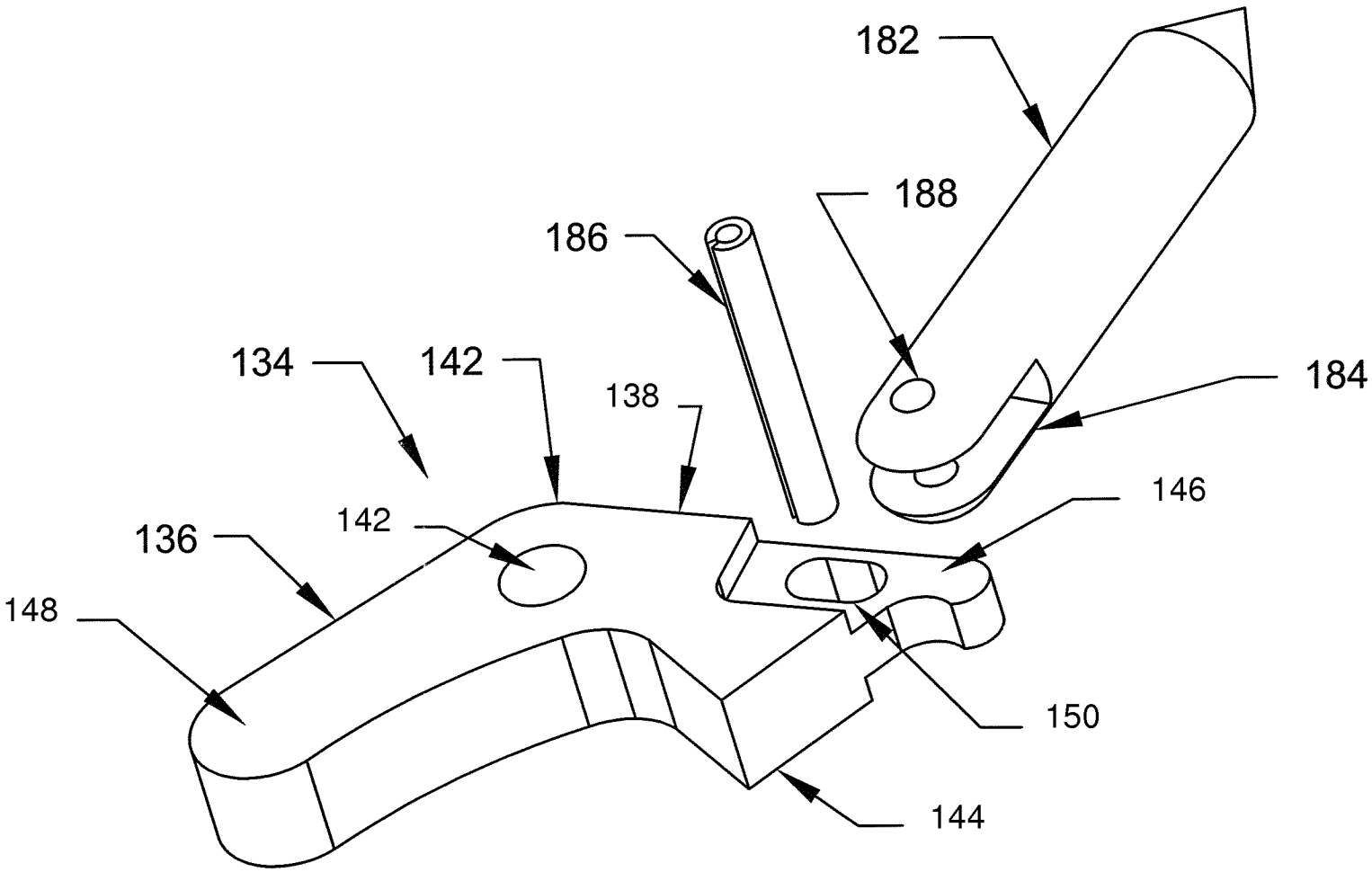
FIG. 7 is a detail view of a first exemplary embodiment of a release catch, including the roll pin and piston.

A solenoid 180, as shown in FIGS. 5 and 7, is mounted within the housing 80 and is associated with a piston 182 which extends through an aperture 88 in the bottom plate 85. The piston 182 has a distal end terminating in a clevis 184. The clevis 184 has an aperture 188 through which passes a roll pin 186. The roll pin 186 also passes through the clevis tang aperture 150. The roll pin 186 thus operatively connects the piston 182 with the release catch 134. The solenoid 180 may have a pair of connectors 190 to permit electrical connection, as described further hereinbelow. The solenoid 180 may optionally be of a type which can detect the position of the piston 182 and provide a signal indicating whether the piston is in the extended or retracted position, which would inform a remote facility manager whether the locking apparatus was in the locked condition or unlocked condition.

Figure 8:
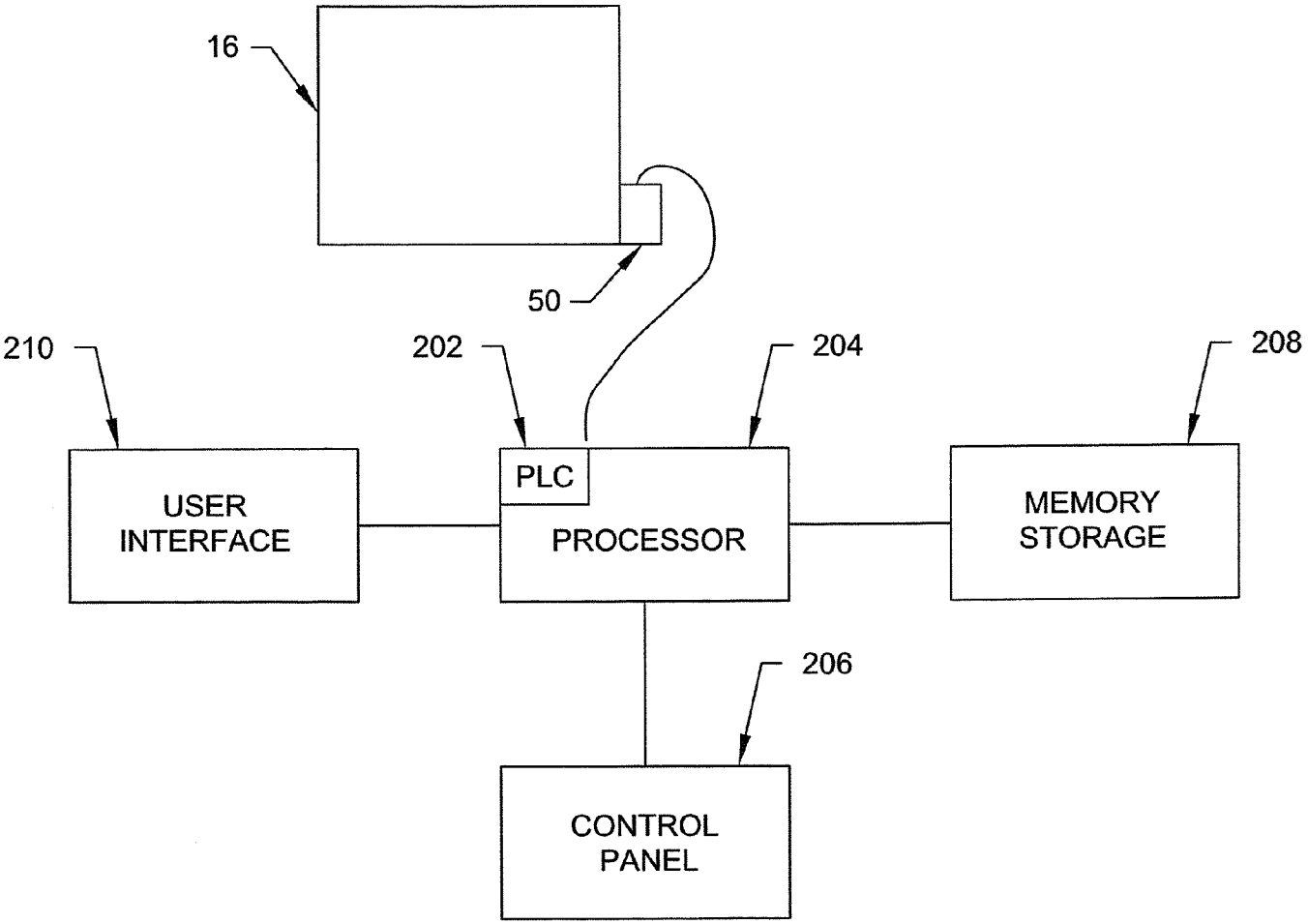
FIG. 8 is a schematic view of a door, lock apparatus and electronic control aspects.

The locking apparatus 50 further includes an access control assembly 56, as shown in FIG. 8, which has a programmable logic controller ("PLC") 202, as part of a processor 204, which is in electronic communication with the solenoid 180. The control assembly may include an access control interface 206 (such as, but not limited to, a keypad, key/lock, magnetic or optical card reader, bar code reader, keypad, radio frequency identification tag, fingerprint, eye or other biometric scanner, voice recognition device, combinations of the foregoing and the like), and a facility manager accessible control interface. The access control assembly 56 may also include memory storage device 208 for storing and retrieving user access identification information and for managing access and generating reports. A facility manager or other authorized user may access the processor via a control panel 210.

Figure 9:
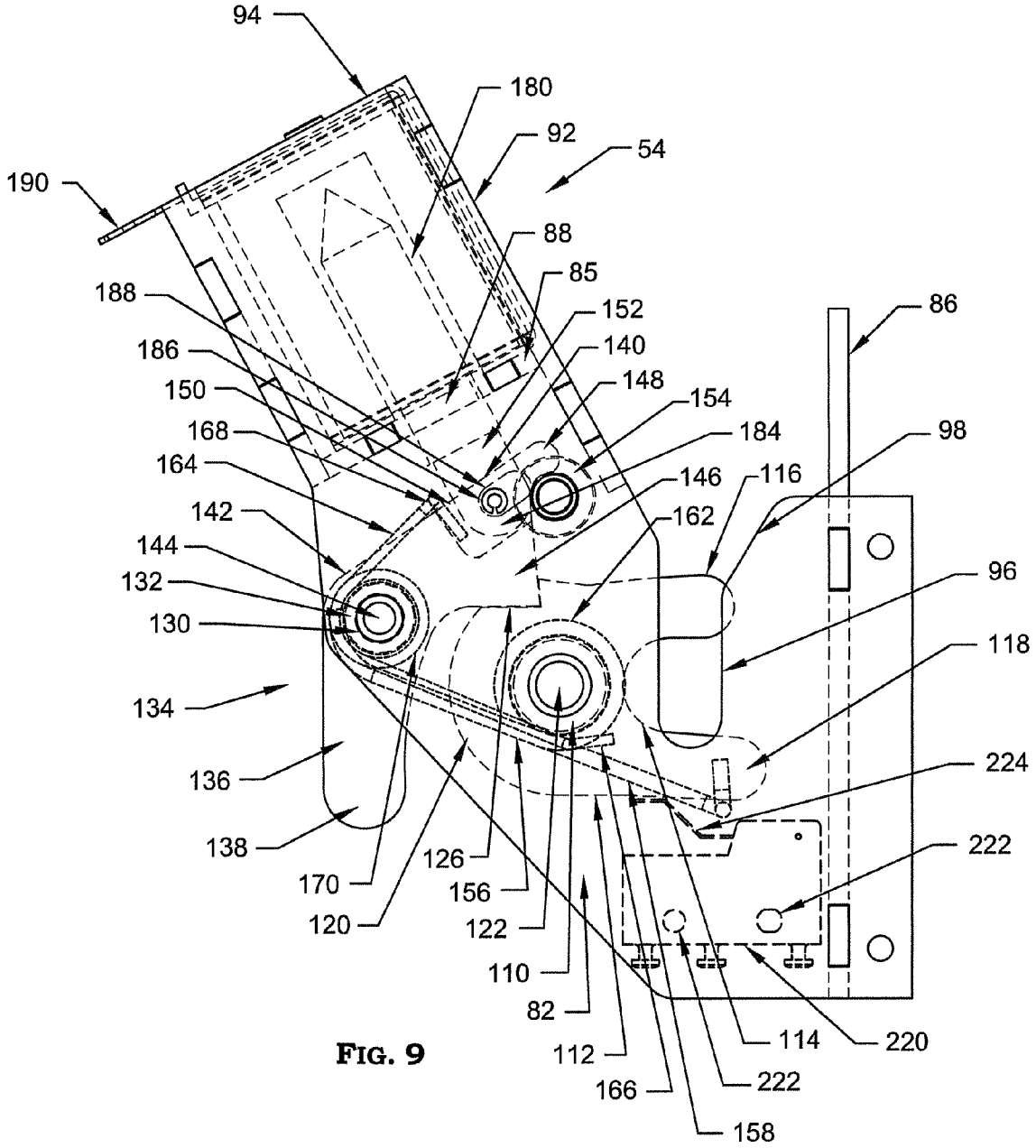
FIG. 9 is a side schematic view of an alternative embodiment of the latch assembly which includes a microswitch.

The locking apparatus 50 may optionally further include, as shown in FIG. 9, a sensor, such as, but not limited to, a microswitch 220 mounted in the housing via a plurality of mounting apertures 222 or, alternatively, via welding, gluing or other methods of attachment. The microswitch 220 has a contact arm 224 which can contact the trigger latch 112 and detect when the trigger latch 112 has been rotated (and the door unlocked or locked). The microswitch 220 is in electronic communication with the PLC 202. The microswitch 220 can be used to detect whether the locking apparatus 50 is in the locked or unlocked state and either state can be signaled to the PLC 202, which can display the state on the control panel 210. Alternatively, instead of a microswitch, an optical, motion detection or other type of sensor known to those skilled in the art can be utilized.

Figure 10:
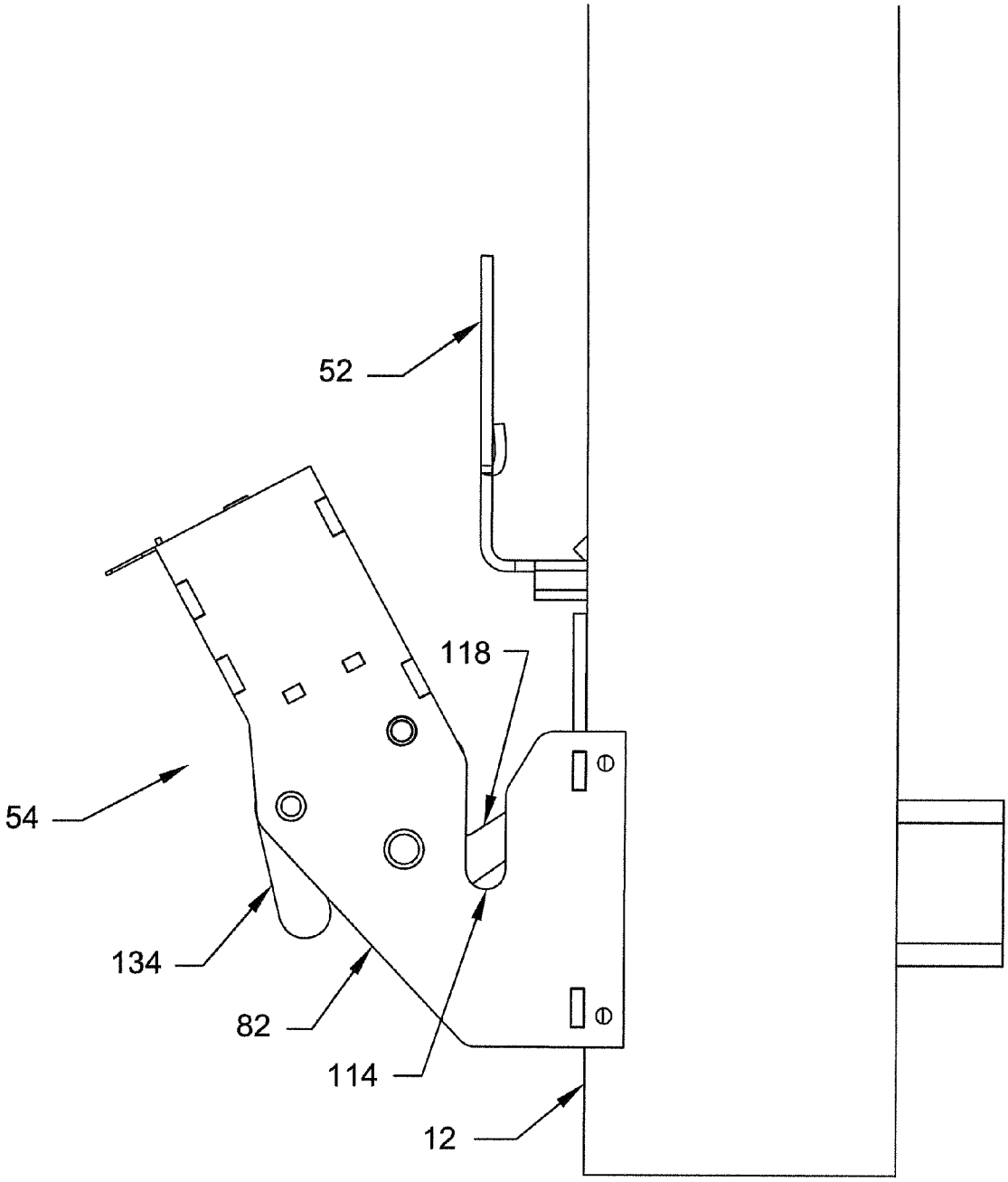
FIG. 10 shows the first embodiment of the lock apparatus in an unlocked position with the striker member positioned above the latch assembly.

In operation the locking apparatus 50 is mounted to one of the vertical guide tracks 12 or 14, or proximate thereto. In the unlocked position, shown in FIG. 10, the striker plate 68 is positioned above the latch assembly 54. The trigger latch second leg 118 is shown angled upward so that the U-shaped opening is angled upward as biased by the first spring 156. The locking tab 144 of the release catch 134 is not engaged with the locking notch 126 in the trigger latch 54. The piston 182 is in a retracted position and the second spring 164 urges the release catch 134 so that the stop finger 146 is clear of the stop pin 154.

Figure 3:
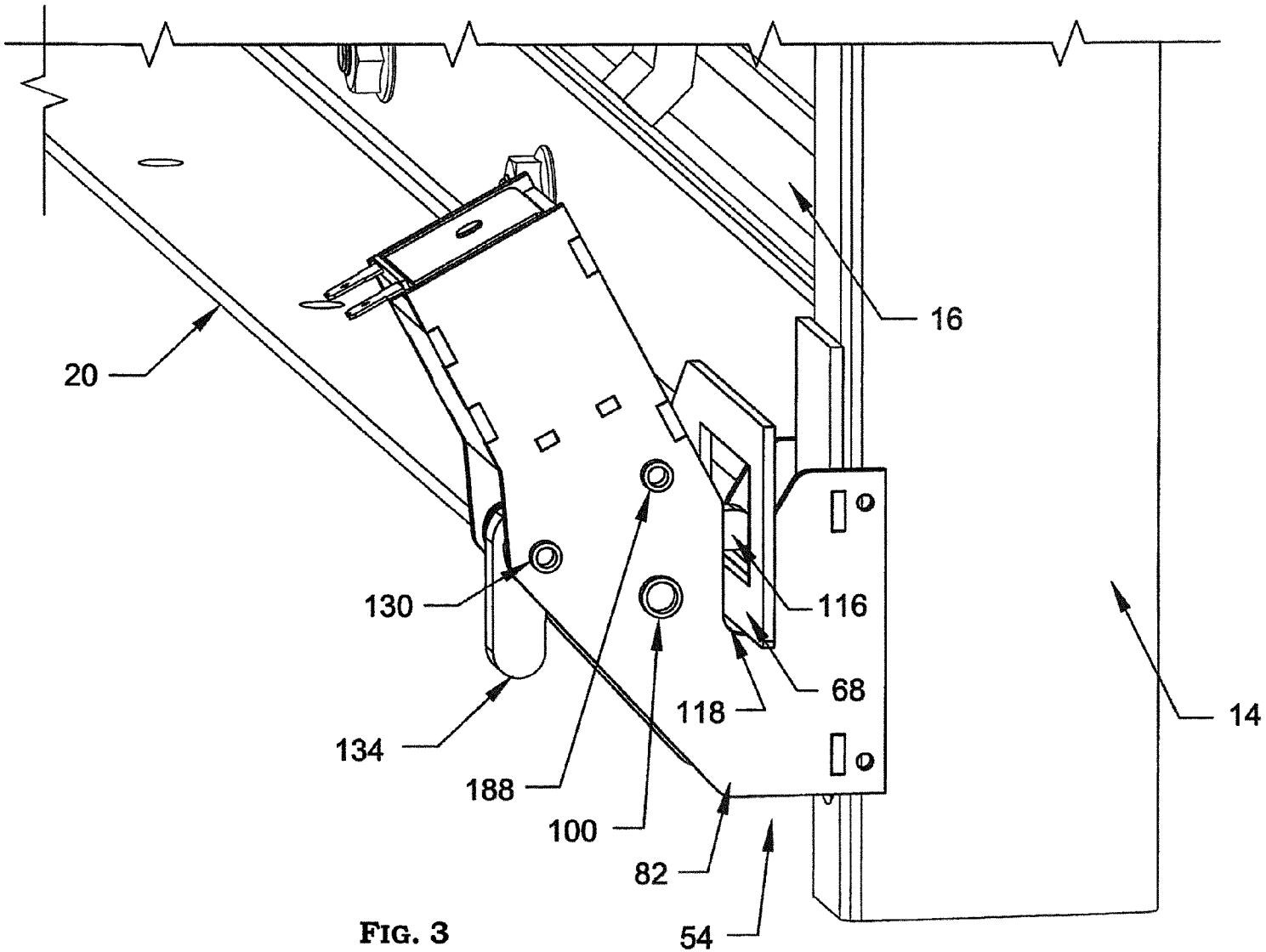
FIG. 3 is a perspective view of the lock apparatus embodiment of FIG. 2 and showing the engagement of the striker plate by the trigger latch.

The rollup door 16 is lowered and the striker plate opening 70 (or, in an alternative embodiment, the striker plate finger, as described further hereinbelow) slides into the latch assembly slots 114 and engages the pivoted trigger latch U-shaped opening 114, as shown in FIGS. 2-3. As the striker plate 68 lowers further into the slots 96, the trigger latch 112 pivots on the first pin 100 so that the trigger latch U-shaped opening 114 rotates into a horizontal position and engages the striker plate 68 through the opening 70. Simultaneously with the pivoting of the trigger latch 112 the release catch 134 pivots on the second pin 130 and the release catch locking tab 144 slides into and engages the trigger latch notch 126. Also simultaneously, the release catch stop finger 146 contacts the stop pin 154. The weight of the striker plate 68 (and the door) hold the striker member 52 in position. The striker plate 68 is engaged between the side plate slots 82, 84 and the trigger latch U-shaped opening 114 and is locked in place, thereby locking the door 16 in the lowered position.

The piston 182 is maintained in the extended position while the door 16 is locked. When the door 16 is to be opened and access given to a storage unit, the processor 204 sends a signal and actuates the solenoid 180 to retract the piston 182. This allows the release catch 134 to pivot so that the locking tab 144 disengages from the locking notch 126 and the first spring 156 urges the trigger latch 112 to pivot when the striker plate 68 is raised as the door 16 is opened. The processor 204 may be accessed either by a user entering proper access information into a user interface 206, or, a facility manager entering access authorization into a user interface 206 or control panel 210.

The release 134 catch can be manually pivoted to unlock the door 16 by pressing down on the release catch first portion finger 148, which causes the release catch tab 144 to disengage from the trigger latch notch 126 and allows the trigger latch 112 and the U-shaped opening 114 to pivot, thereby releasing the striker plate 62 allowing the door 16 to be raised. This can be an important feature where someone is inadvertently locked inside a storage unit and the locking apparatus 50 engaged or if there is a power outage.

Figure 11:
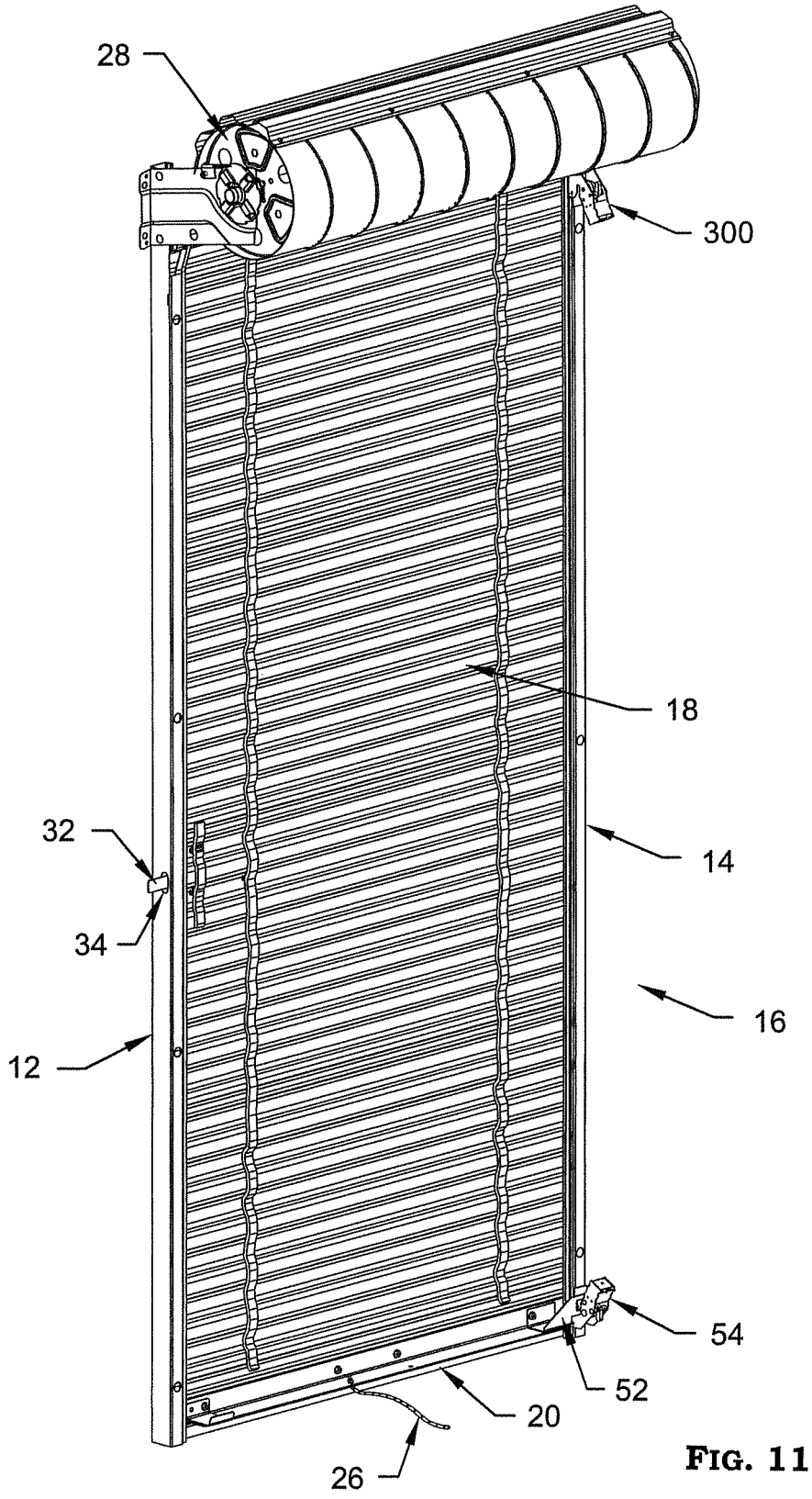
FIG. 11 shows a perspective view of an alternative exemplary embodiment showing a rollup door with a striker member and two latch assemblies.
Figure 12:
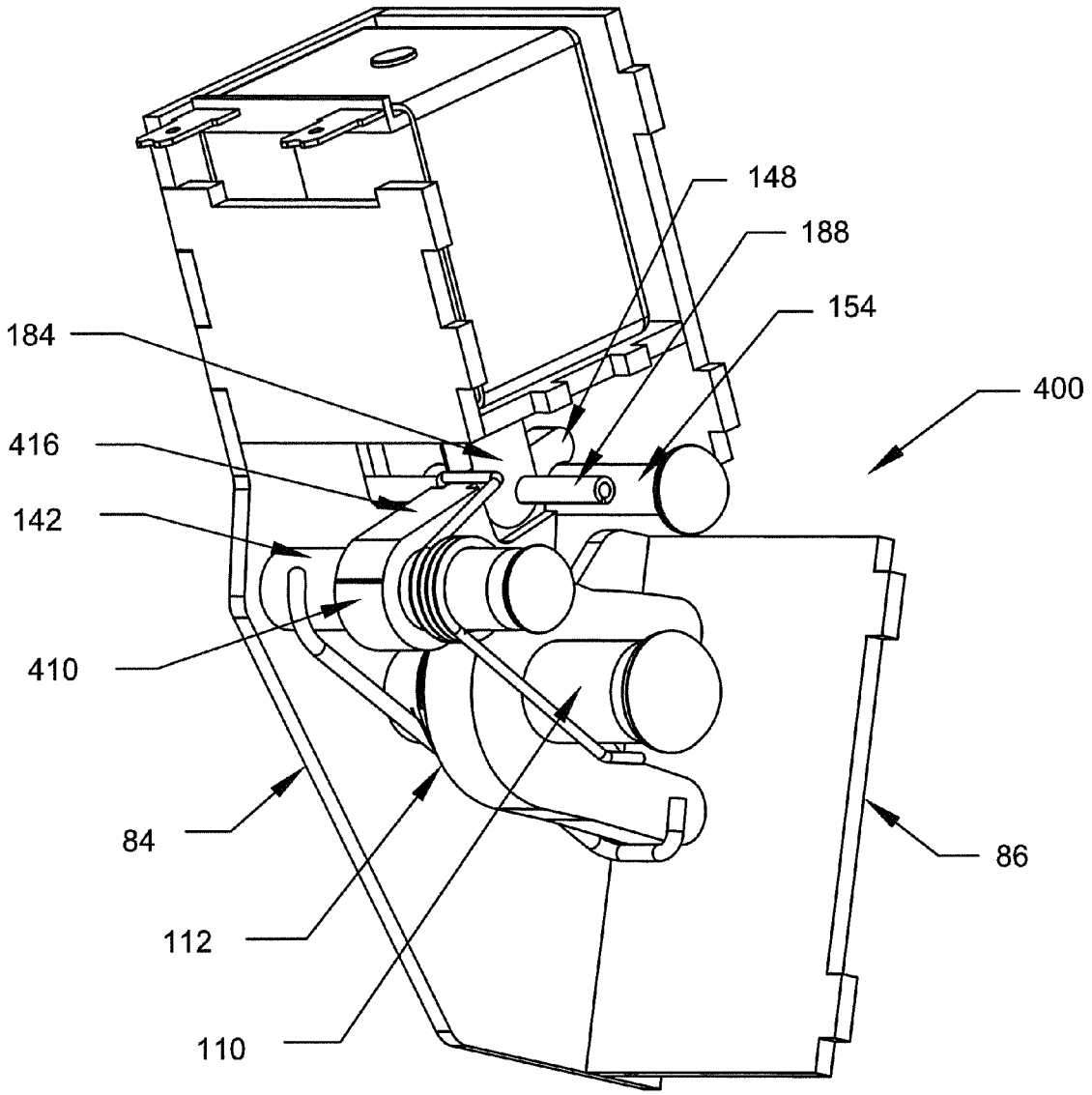
FIG. 12 is a perspective view in partial cutaway of a second exemplary embodiment of a lock apparatus showing the latch assembly having a release catch without the manual release feature.
Figure 13:
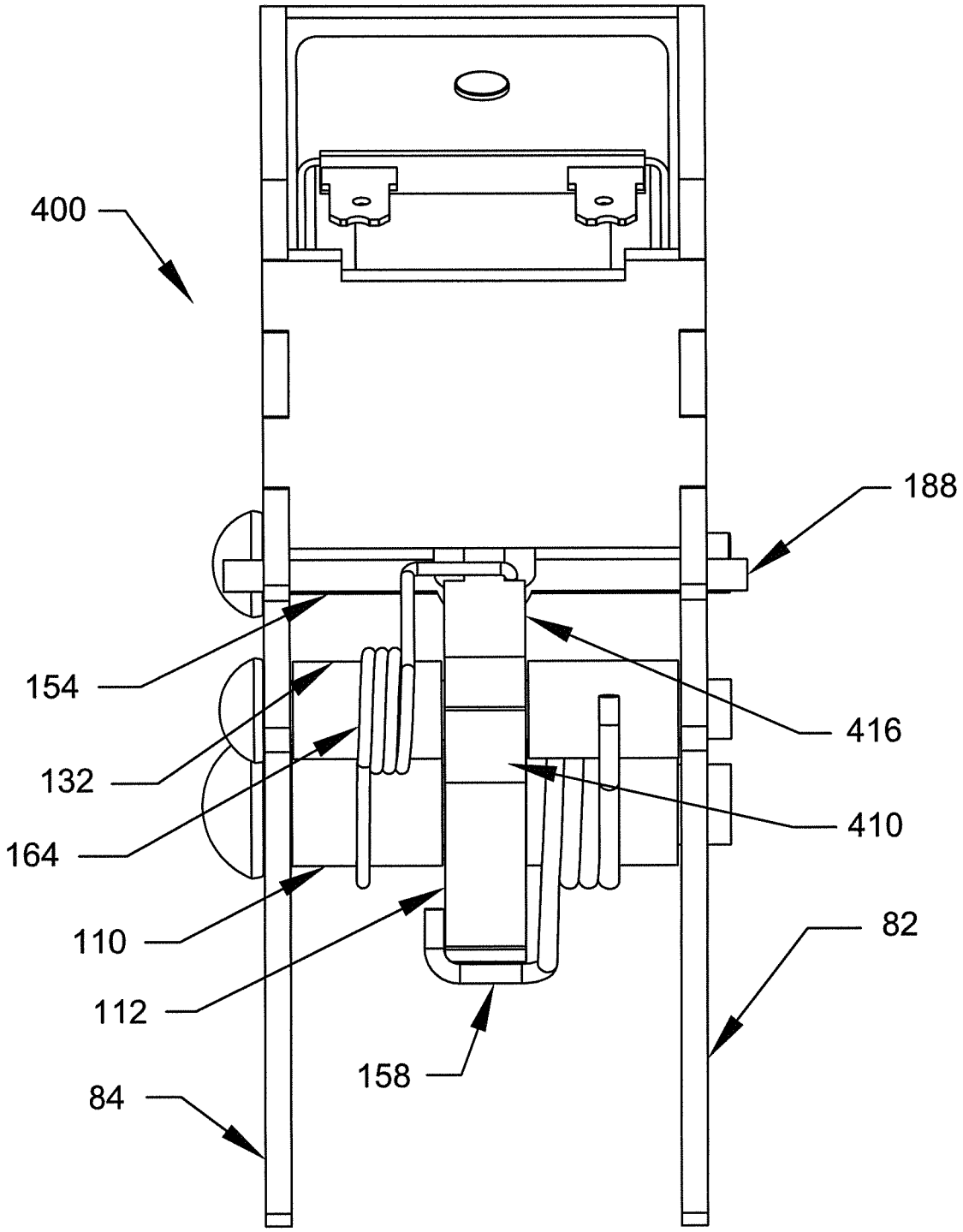
FIG. 13 is a front elevational view of the second exemplary embodiment of FIG. 12.
Figure 14:
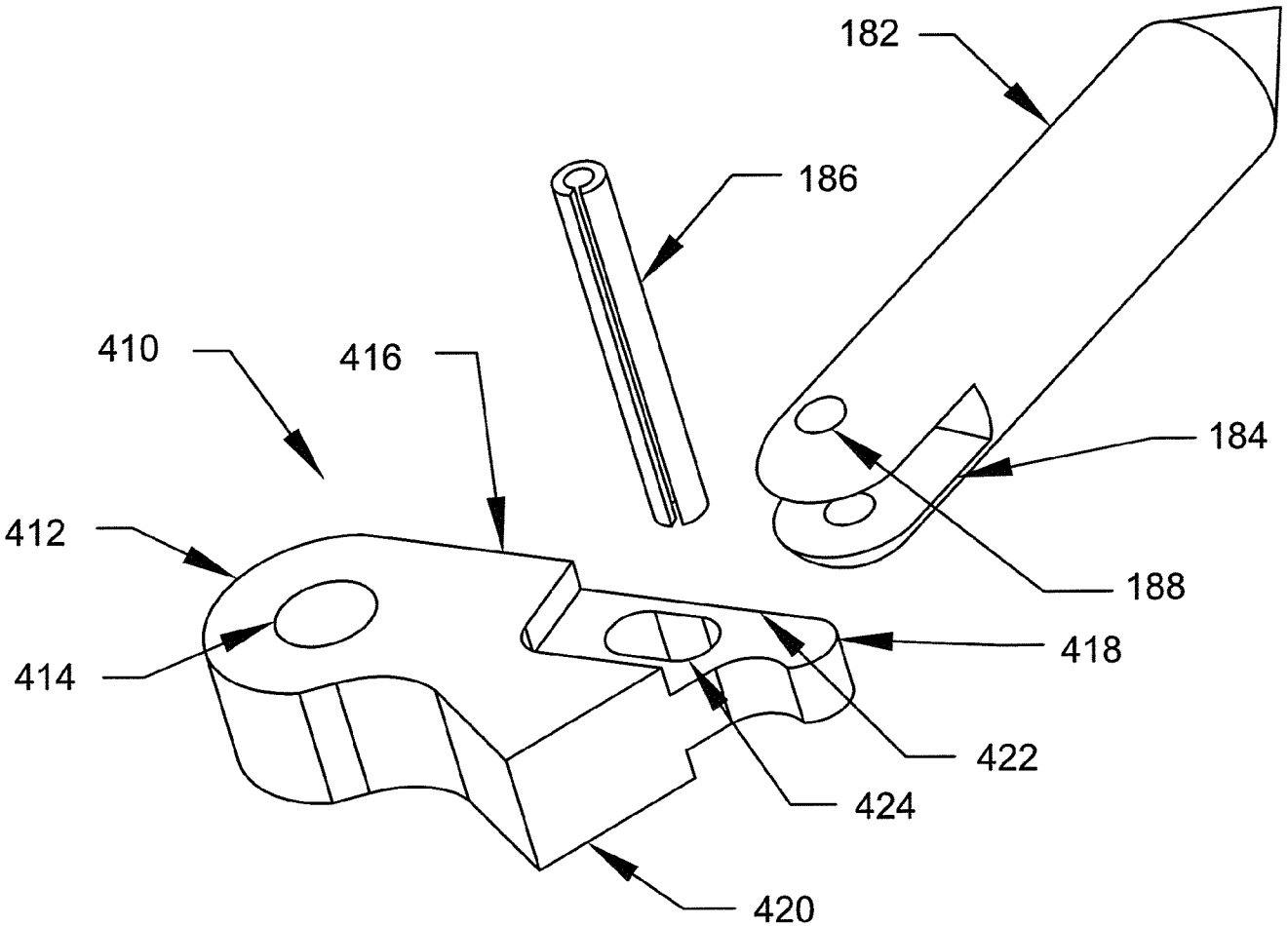
FIG. 14 is a detail view of the second exemplary embodiment of FIG. 12, showing a release catch, roll pin and piston.
Figure 15:
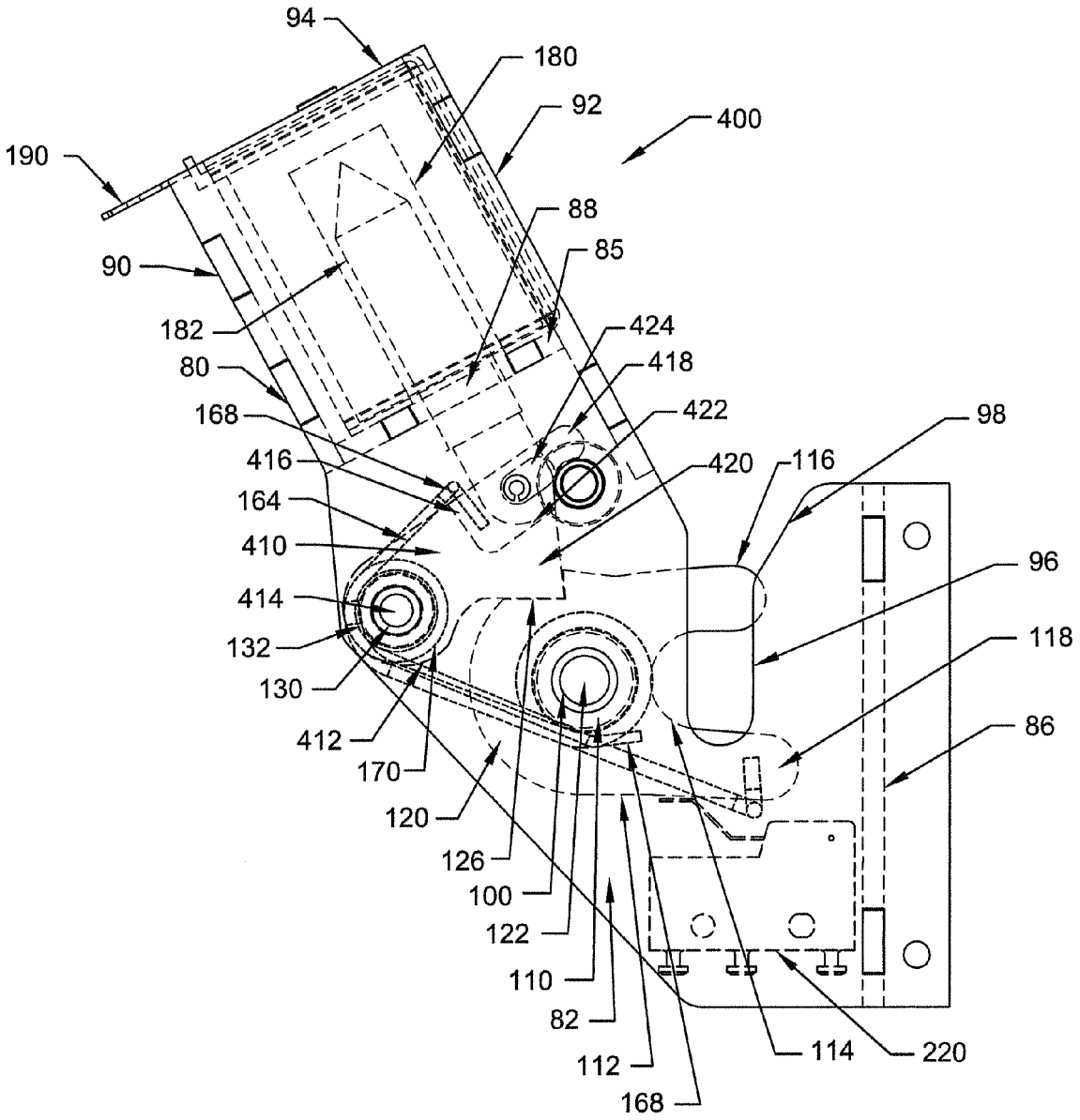
FIG. 15 is a side schematic view of the second exemplary embodiment of FIG. 12.

In an alternative exemplary embodiment, shown in FIG. 11, a rollup door system may include a second latch assembly 300. In this embodiment a latch assembly 54 is mounted at the bottom of the door guide track as described hereinabove, and the second latch assembly 300 is mounted toward the upper part of one of the guide tracks 12, 14. The second latch assembly 300, which is also in electronic communication with the control assembly 56, may be used to maintain the door 16 in an open position where closing (rather than opening) of the door is to be monitored and limited (for example, for a door which is to remain open at all times during business hours, unless closure is authorized by, e.g., security personnel). In this embodiment a facility manager can determine whether the door is in a raised or lowered position because the striker plate 62 will engage either the upper latch assembly 300 or the lower latch assembly 54, unless the door is in the process of being raised or lowered (or if the door is partially open, which itself can trigger an alarm on the control panel 210 to alert the facility manager that a door has not been opened or closed all the way).

In an alternative exemplary embodiment a latch assembly 400 has a release catch 410 provided as one without a manual release feature, as shown in FIGS. 12-15 (shown in the drawings including an optional, but not required, microswitch 220, as discussed hereinabove). In this embodiment the release catch 410 has a first portion 412 having a hole 414 passing therethrough which can accept the second pin 130, as described hereinabove. The release catch 410 also has a second portion 416 having a stop finger 418 at the distal end and a locking tab 420, but the second portion 416 is shorter compared to the second end portion 138 and does not include the manual release feature. The second portion 416 also has, similar to release catch 134, a narrower width area with a hole or slot 422 extending therethrough to create a clevis tang 424 for receiving the roll pin 188.

Figure 16:
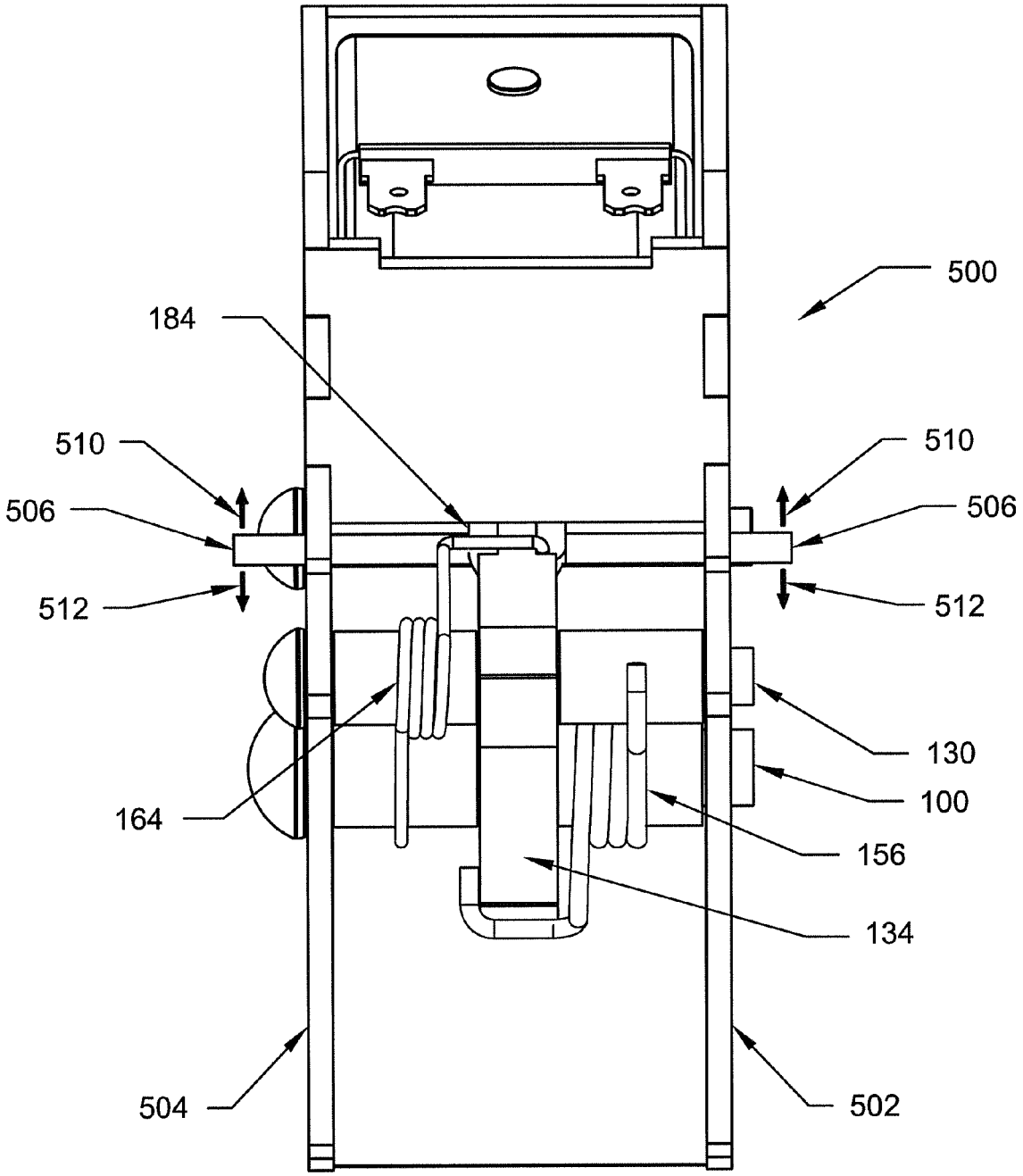
FIG. 16 is a front elevational view of a third exemplary embodiment showing a manual release feature in the form of a longer roll pin.
Figure 17:
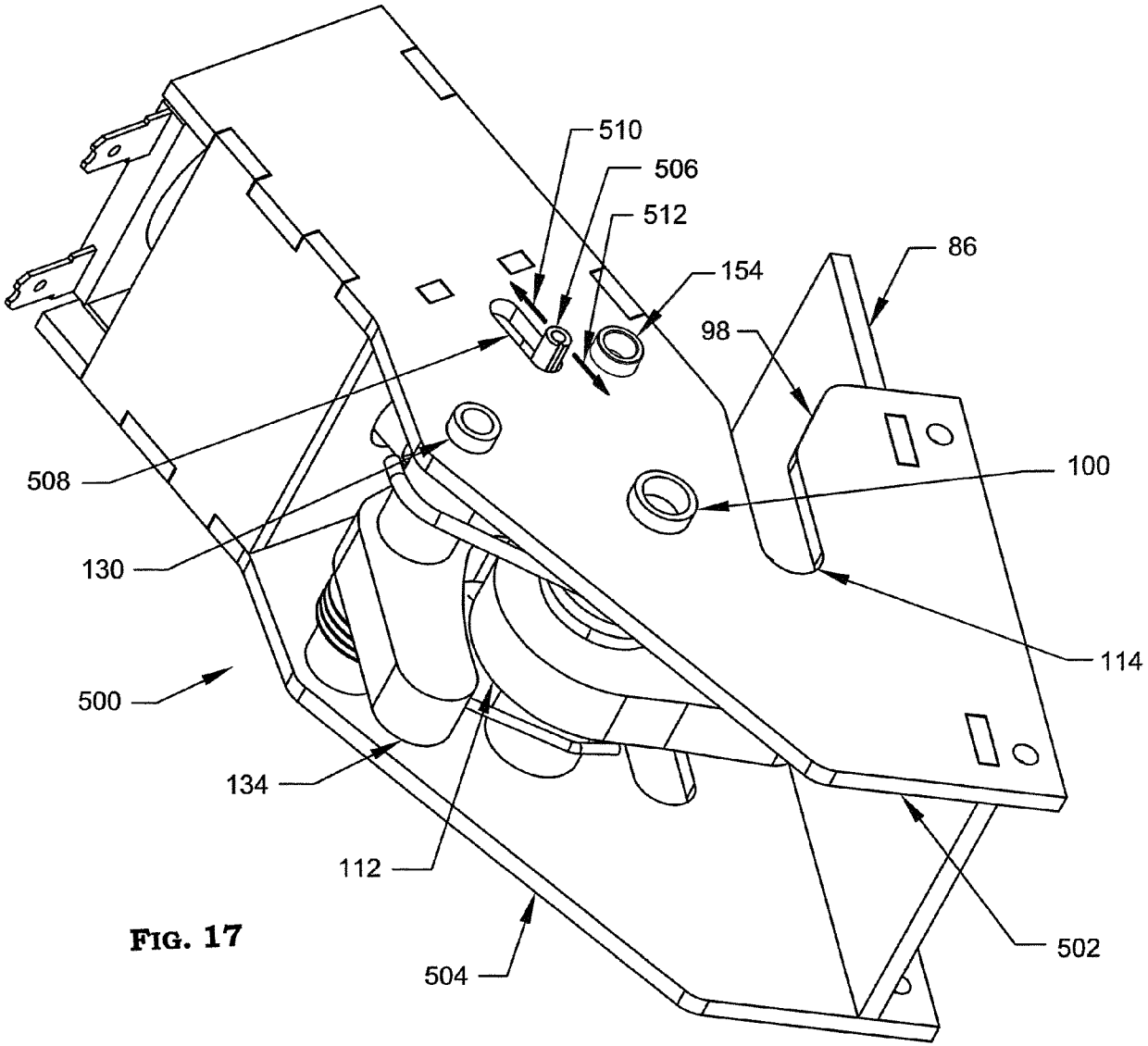
FIG. 17 is a perspective view of the third exemplary embodiment of FIG. 16 and showing the longer roll pin within a slot in the first side plate.

In an alternative exemplary embodiment of a latch assembly 500, shown in FIGS. 16-17, a longer roll pin 502 extends through the clevis tang 152 as described hereinabove and also extends through both the first and side plates 504, 506, via a slot 508 in each first and side plates. A user can manually slide the roll pin 502 within the slots 508 in the directions of arrows 510 or 512 to manually move the piston 182 so as to disengage the release catch 134 from the trigger latch 112.

Figure 18:
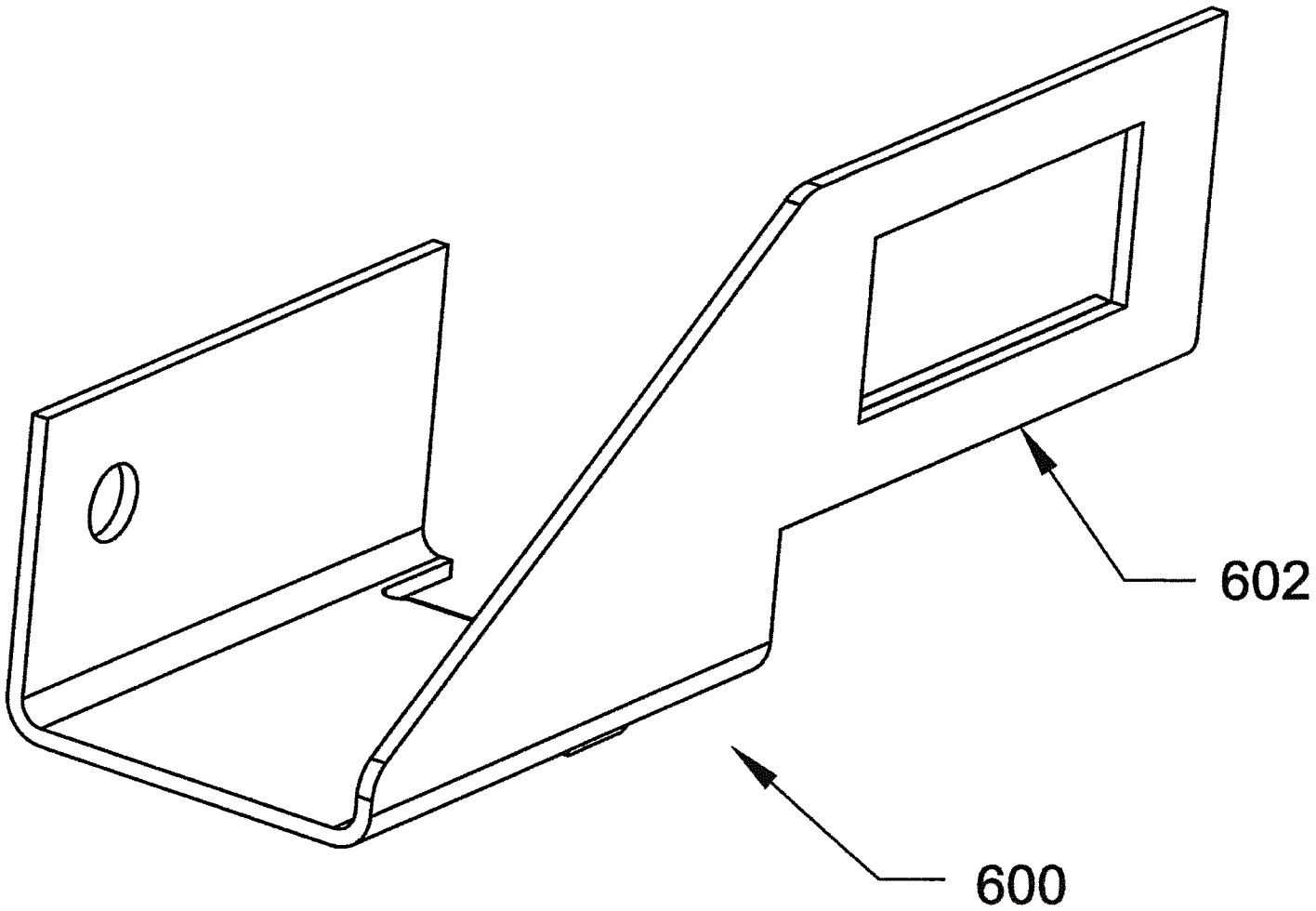
FIG. 18 is a perspective view of a fourth exemplary embodiment showing a striker member having a striker plate finger.

In another exemplary embodiment of the striker member, shown in FIG. 18, a striker member 600 is constructed having a striker plate 602 formed as a projecting finger, rather than as an opening in a plate. It is to be understood that the striker plate 602 can be any of a number of suitable geometries, including, but not limited to, straight, curved, angled, beveled, or the like.

Another exemplary embodiment of the present disclosure provides a rollup door system providing electronically controlled access. The system includes a rollup door adapted to move within a pair of opposing guide tracks, a striker member as described herein, a latch assembly as described herein, and a control assembly as described herein.

Another exemplary embodiment of the present disclosure provides a method of controlling access to a door from a remote location. A locking apparatus 50 is mounted to a rollup door 16 as described hereinabove. When a storage unit tenant (for example) desires access to the storage unit, the tenant enters his/her access identification information using any of several possible interfaces 206, such as those described hereinabove. The information is compared to a value stored in a memory storage device 208. If the tenant information is validated, the processor 204 sends a signal to the solenoid 180, which retracts the piston 182, causing the release catch 134 to pivot and the locking tab 144 to disengage from the trigger latch notch 126. The trigger latch 112 is rotated (as urged by the first spring 156), thereby disengaging the striker plate 62 and allowing the door 16 to be raised. When the tenant recloses and locks the door 16, the striker plate 62 reengages and is locked in place by the trigger latch 112.

A facility manager can monitor access to a number of storage units and determine which units have been accessed and when. The processor can log when the door was opened and a report can be generated from the data.

In another exemplary embodiment, the locking apparatus of the present disclosure can be adapted to provide wireless remote access control. Such an apparatus can use the locking apparatus as described hereinabove, but also include a wireless transceiver associated with the solenoid (and may also be associated with the microswitch, if included).

Although only a number of exemplary embodiments have been described in detail above, those skilled in the art will readily appreciate that many modifications are possible in the exemplary embodiments without materially departing from the novel teachings and advantages. Accordingly, all such modifications are intended to be included within the scope of this disclosure as defined in the following claims.

While the methods, equipment and systems have been described in connection with specific embodiments, it is not intended that the scope be limited to the particular embodiments set forth, as the embodiments herein are intended in all respects to be illustrative rather than restrictive.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; the number or type of embodiments described in the specification.

As used in the specification and the appended claims, the singular forms "a," "an" and "the" include plural referents unless the context clearly dictates otherwise. "Optional" or "optionally" means that the subsequently described event or circumstance may or may not occur, and that the description includes instances where said event or circumstance occurs and instances where it does not. Throughout the description and claims of this specification, the word "comprise" and variations of the word, such as "comprising" and "comprises," means "including but not limited to," and is not intended to exclude, for example, other additives, components, integers or steps. "Exemplary" means "an example of" and is not intended to convey an indication of a preferred or ideal embodiment. "Such as" is not used in a restrictive sense, but for explanatory purposes.

Disclosed are components that can be used to perform the disclosed methods, equipment and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods, equipment and systems. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

It will be apparent to those skilled in the art that various modifications and variations can be made without departing from the scope or spirit. Other embodiments will be apparent to those skilled in the art from consideration of the specification and practice disclosed herein. It is intended that the specification and examples be considered as exemplary only, with a true scope and spirit being indicated by the following inventive concepts.

Any patents, applications and publications referred to herein are incorporated by reference in their entirety.

What is claimed is:

1. An electronic lock apparatus for a rollup door system, the rollup door system including a rollup door having a bottom including an elongated base member, the electronic lock apparatus comprising:

a) a striker member including a mounting portion and a striker plate, the mounting portion being adapted for mounting to the door base member b) a latch assembly including i) a housing including first and second opposing side panels, each panel having a slot, ii) a first pin associated with the housing, iii) a second pin associated with the housing iv) a release catch having a first end portion, a second end portion which can contact the first pin, a middle portion having a tab extending therefrom, and an aperture through which the second pin passes, the release catch second end portion having an area with a narrower width and an aperture defined therein defining a clevis tang, the release catch further comprising a finger extending from the release catch first end portion and extending outside of the housing, the finger being manually operable to cause the release catch to pivot and cause the release catch tab to be released from the trigger latch notch, thereby causing the trigger latch to pivot and release the striker plate, v) a trigger latch having a generally U-shaped opening defined by a first leg, a second leg, and a middle section pivotably mounted to the first pin through an aperture defined in the trigger latch middle section, the trigger latch having a notch defined in the middle section which can engage the release catch tab, vi) a first spring having a first end, second end, and wound middle portion, the first end being associated with the trigger latch, the second end being associated with the second pin, and the wound middle portion being associated with the first pin, such that the trigger latched is biased by the first spring in an unlocked first position, vii) a second spring having a first end, second end, and wound middle portion, the second spring first end being associated with the first pin and the second spring middle portion being associated with the second pin, viii) a solenoid associated with the housing, ix) a piston associated with the solenoid and having a clevis defined in one end, and x) a roll pin adapted to connect the piston clevis and the release catch clevis tang; and c) a control assembly including a programmable logic controller, processor, memory storage and a user interface, the control assembly being in electronic communication with the solenoid, wherein a user can input identification information into the user interface.

2. An electronic lock apparatus for a rollup door system, the rollup door system including a rollup door having a bottom including an elongated base member, the electronic lock apparatus comprising:

a) a striker member including a mounting portion and a striker plate, the mounting portion being adapted for mounting to the door base member; and, b) a latch assembly including i) a housing including first and second opposing side panels, each panel having a slot, ii) a first pin associated with the housing, iii) a second pin associated with the housing iv) a release catch having a first end portion, a second end portion which can contact the first pin, a middle portion having a tab extending therefrom, and an aperture through which the second pin passes, the release catch second end portion having an area with a narrower width and an aperture defined therein defining a clevis tang, v) a trigger latch having a generally U-shaped opening defined by a first leg, a second leg, and a middle section pivotably mounted to the first pin through an aperture defined in the trigger latch middle section, the trigger latch having a notch defined in the middle section which can engage the release catch tab, vi) a first spring having a first end, second end, and wound middle portion, the first end being associated with the trigger latch, the second end being associated with the second pin, and the wound middle portion being associated with the first pin, such that the trigger latched is biased by the first spring in an unlocked first position, vii) a second spring having a first end, second end, and wound middle portion, the second spring first end being associated with the first pin and the second spring middle portion being associated with the second pin, viii) a solenoid associated with the housing, ix) a piston associated with the solenoid and having a clevis defined in one end, and x) a roll pin adapted to connect the piston clevis and the release catch clevis tang, wherein the roll pin is dimensioned to extend transversely through a slot defined in each of the first and second side panels of the housing, the roll pin being adapted to be manually slidable within the slots so as to move the piston and cause the trigger latch to pivot.

3. An electronic lock apparatus for a rollup door system, the rollup door system including a rollup door having a bottom including an elongated base member, the electronic lock apparatus comprising:

a) a striker member including a mounting portion and a striker plate, the mounting portion being adapted for mounting to the door base member; and, b) a latch assembly including i) a housing including first and second opposing side panels, each panel having a slot, ii) a first pin associated with the housing, iii) a second pin associated with the housing iv) a release catch having a first end portion, a second end portion which can contact the first pin, a middle portion having a tab extending therefrom, and an aperture through which the second pin passes, the release catch second end portion having an area with a narrower width and an aperture defined therein defining a clevis tang, the release catch further comprising a stop finger extending from the release catch second portion and wherein the latch assembly further comprises a stop pin associated with the housing such that the stop finger is adapted to contact the stop pin when the release catch is pivoted into a locked position, v) a trigger latch having a generally U-shaped opening defined by a first leg, a second leg, and a middle section pivotably mounted to the first pin through an aperture defined in the trigger latch middle section, the trigger latch having a notch defined in the middle section which can engage the release catch tab, vi) a first spring having a first end, second end, and wound middle portion, the first end being associated with the trigger latch, the second end being associated with the second pin, and the wound middle portion being associated with the first pin, such that the trigger latched is biased by the first spring in an unlocked first position, vii) a second spring having a first end, second end, and wound middle portion, the second spring first end being associated with the first pin and the second spring middle portion being associated with the second pin, viii) a solenoid associated with the housing, ix) a piston associated with the solenoid and having a clevis defined in one end, and x) a roll pin adapted to connect the piston clevis and the release catch clevis tang.

* * * * *